United States Patent [19]

Perry

[11] Patent Number: 4,847,925

[45] Date of Patent: Jul. 18, 1989

[54] COVER FOR A POOL, HOT TUB OR THE LIKE

[76] Inventor: Cliff R. Perry, 934 S. 295th Pl., Federal Way, Wash. 98003

[21] Appl. No.: 111,991

[22] Filed: Oct. 22, 1987

[51] Int. Cl.[4] ..... E04H 3/19

[52] U.S. Cl. ..... 4/499; 4/498; 4/503; 52/2

[58] Field of Search ..... 4/499, 503, 502, 501, 4/500; 52/2

[56] References Cited

U.S. PATENT DOCUMENTS

| | | | |
|---|---|---|---|
| 2,888,717 | 6/1959 | Domitrovic | 4/499 |
| 3,355,745 | 12/1967 | Jannuzzi | 4/503 |
| 3,366,977 | 2/1968 | Koehler | 4/499 |
| 3,523,308 | 8/1970 | Bradley | 4/172 |
| 3,533,110 | 10/1970 | Gisondi | 4/499 |
| 3,600,721 | 8/1971 | Pusey | 4/499 |
| 3,683,427 | 8/1972 | Burkholz et al. | 4/172 |
| 3,801,994 | 4/1974 | Brown | 4/499 |
| 4,122,562 | 10/1978 | Sorrentino | 4/172 |
| 4,537,147 | 8/1985 | Nivin | 114/201 R |
| 4,685,254 | 8/1987 | Terreri | 52/2 |

FOREIGN PATENT DOCUMENTS

| | | | |
|---|---|---|---|
| 2427815 | 1/1976 | Fed. Rep. of Germany | 4/499 |
| 2440458 | 3/1976 | Fed. Rep. of Germany | 4/499 |

*Primary Examiner*—Henry J. Recla

*Assistant Examiner*—Robert Fetsuga

*Attorney, Agent, or Firm*—Hughes & Multer

[57] ABSTRACT

A cover for a pool, hot tub or the like wherein the pool structure has an upper perimeter portion defining a pool area where water is contained. The cover has a first upper flexible sheet member having a first central portion and a first perimeter portion and a second lower flexible sheet member having a second central portion and a second perimeter portion. The first central portion of the first upper sheet member is separated from the second central portion of the second lower sheet by a support member. The support member has a sufficiently large vertical dimension to support the central portion of the first upper sheet member such that the first upper sheet member extends radially outwardly from the first central portion to the first perimeter portion at a moderate downward slope so that water and debris that fall on the cover move outwardly and downwardly from the first central portion of the first upper sheet member. The first perimeter portion of the first upper sheet member is attached substantially entirely around the second perimeter portion of the second lower sheet member and the first upper sheet member is spaced apart from the second lower sheet member by the support member thereby creating an insulating dead air space so as to provide heat insulation for water in the pool. A method for covering a pool structure or the like is also disclosed.

2 Claims, 2 Drawing Sheets

COVER FOR A POOL, HOT TUB OR THE LIKE

BACKGROUND OF THE INVENTION (a) Field of the Invention

The present invention relates generally to a cover for a pool, hot tub or the like and, in particular, to a flexible cover which provides a heat insulating barrier and slopes downwardly and outwardly from a center portion to keep rain, dirt and the like from collecting on its top.

(b) Background Art

With the increased use of home pools and particularly the increase in home hot tubs, an accompanying problem of covering the pool or hot tub has presented itself. Covering a pool or hot tub when it is not in use has presented a problem in that conventional covers generally take one of two forms which have proven unsatisfactory for various reasons. First, a cover in the form of a plastic sheet or canvas which is dropped over the top of the pool has been used. The middle part of the canvas thus extends downwardly from the edge of the pool and across the waters surface. While this prevents evaporation, it does not provide a good thermal barrier as in the case of the present invention. Further, dirt, leaves, etc. will become deposited on the top of the cover and can easily fall into the pool or hot tub when the cover is removed. Another cover is in the form of a floating styrofoam member which is a heavy, bulky device and does not provide a tight seal.

A search of the U.S. patent literature has disclosed a number of prior art patents, these being as follows:

U.S. Pat. No. 3,801,994 to Brown discloses a pool cover and an elevating apparatus for the pool cover whereby air and water bubble up into a container that becomes inflated and the container serves to elevate the pool cover.

U.S. Pat. No. 3,600,721 to Pusey shows a pool cover which has a sheet with a raised inflatable tubular section around its periphery so that the cover is free floating and unattached to the pool sides.

U.S. Pat. No. 3,533,110 to Gisondi discloses a pool cover in which the pool cover itself is an inflatable bag having substantially the same shape as the pool.

U.S. Pat. No. 3,366,977 to Koehler discloses a swimming pool cover which uses a floatable member that is secured underneath a sheet to prevent unwanted material from accumulating at the top of the cover. In Koehler, the inflatable member is a permanent part of the cover.

U.S. Pat. No, 3,355,745 to Jannuzzi discloses a pool cover with an inflated ball fitting loosely beneath the cover.

U.S. Pat. No. 2,888,717 to Domitrovic teaches a cover for a silo which has an inflatable ring covered by a sheet, the ring being filled with water to expand to fit snugly to the silo wall and weighting the ring to follow the level of the silo contents.

SUMMARY OF THE INVENTION

In order to overcome problems inherent in the before-described pool covers, there is taught in the present invention a new and novel cover for a pool, hot tub or the like which comprises a first top and a second bottom sheet members with a support member separating the two sheet members and serving to elevate the top sheet member such that dirt, leaves and the like do not settle on the central portion of the top sheet member. The dead air space created between the two sheet members serves to provide a good thermal barrier thus conserving energy required to reheat a heated pool or hot tub.

It is therefore an object and advantage of the present invention to provide a pool cover such that rain, leaves, dirt and the like will drain and not settle in the center of the cover.

It is a further object and advantage of the present invention to provide a pool cover that will afford heat insulation to the water in the pool.

It is still another object and advantage of the present invention to provide a pool cover that is lightweight and easy to position over the top of a pool or to remove.

It is still yet another object and advantage of the present invention to provide a pool cover that is collapsible and easily stored when not in use.

Another object and advantage of the present invention is to provide a pool cover wherein the support member is easily replaceable thus making the pool cover economical to maintain.

Another object and advantage of the present invention is to provide a pool cover which can be adapted to fit any shape or size pool.

These and other objects and advantages of the invention will become apparent from a review of the drawings of the invention and from a reading of the description of the preferred embodiment.

DESCRIPTION OF THE PREFERRED EMBODIMENT

Figure 1:
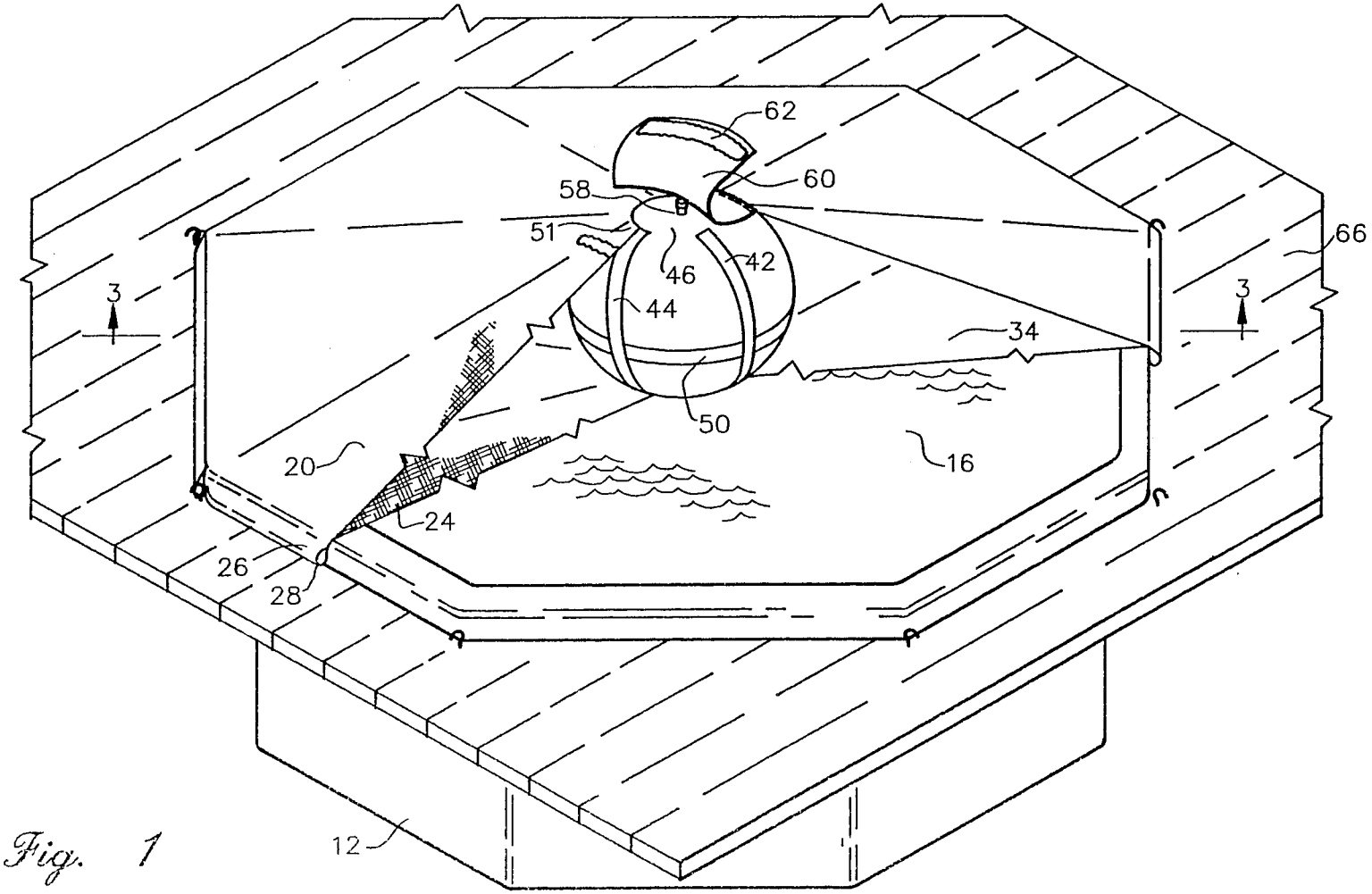
FIG. 1 is a side perspective view showing portions of the cover broken away.

Referring now to the drawings in general and, in particular, to FIG. 1 of the drawings, there is shown a perspective view showing portions of the cover broken away wherein the cover for a pool or the like is shown generally by the numeral 10. The cover 10 is shown positioned over pool structure 12, the pool structure 12 having an upper perimeter 14 defining a pool area 16 wherein water is contained having an upper water surface 18. While in FIG. 1 the cover 10 is shown in use with a pool structure 12 in the form of a hot tub, it is to be understood that the cover 10 can be adapted to accommodate any size, shape or type of pool structure.

The cover 10 comprises a first upper flexible sheet member 20, a central support and spacing member 22 and a second lower flexible sheet member 24. The upper sheet member 20 has a perimeter portion 26 which is fixedly connected (e.g., by sewing or bonding) to a perimeter portion 28 of the lower sheet member 24. These two perimeter portions 26 and 28 are connected to one another around substantially the entire circumference of these perimeter portions 26 and 28, and the connection is made in a manner to substantially inhibit passage of air through the perimeter connection.

The support member 22 has a sufficiently large vertical dimension to support the first central portion 30 of the first upper flexible sheet member 20 such that the first upper flexible member 20 extends radially outwardly from the first central portion 30 to the first perimeter portion 26 at a moderate downward slope. The second lower flexible sheet member 24 extends radially outwardly from the second central portion 32 to the second perimeter portion 28 at a moderate upward slope. The cover 10 is thus characterized in that when it is spread out and positioned across the pool area 16 the first upper flexible sheet member 20 and the second lower flexible sheet member 24 are spaced from one another to define a substantially closed insulating chamber 34 which creates an insulating dead air space 36 so as to provide heat insulation for water in the pool. The downward sloping of the first upper flexible sheet member 20 serves to cause debris or water that falls on the cover 10 to move outwardly and downwardly from the first central portion 30 of the first upper sheet member 20. In the preferred embodiment, support member 22 is in the form an inflatable ball 38 which can be a conventional beach ball. One advantage of using a conventional beach ball as a support member 22 is that should the support member 22 need replacing for whatever reason the user need only purchase a conventional beach ball thus making maintenance of the cover 10 extremely economical.

Inflatable ball 38 is shown as it is positioned within containing structure shown generally by the numeral 40. The containing structure 40, in the preferred embodiment, is in the form of a harness 42 which is adapted to fit around inflatable ball 38. The harness 42 holds inflatable ball 38 securely in position while still allowing the inflatable ball 38 to be removable and thereby easily replaceable.

In the preferred embodiment, the containing structure 40 in the configuration of a harness 42 is formed by four vertically aligned longitudinal straps 44 which extend from the top of the inflatable ball 46 to the bottom of the inflatable ball 48. The four vertically aligned longitudinal straps 44 are attached by sewing or other suitable manner to a single horizontal strap 50 which extends laterally around the center of the ball 52. The four vertically aligned longitudinal straps 44 all converge and are attached to one another and to the second central portion 32 of the second lower sheet member 24 by sewing or other suitable means. As can be seen in FIG. 1, the four longitudinal straps 44 also almost converge at the first central portion 30 of the first upper sheet member 20 but instead the four longitudinal straps 44 terminate at an upper central opening 51 such that the top of the inflatable ball 46 is positioned at the central opening 51. It is to be noted, therefore, that the second lower sheet member 24 is substantially closed with no central opening and is water impervious. The four longitudinal straps 44 are attached at the first central portion 30 of the first upper sheet member 20 and at the second central portion 32 of the second lower sheet member 24 so as to hold the inflatable ball 38 securely in a central location 53 of the cover 10. With the inflatable ball 38 held securely in a central location 53 of the cover 10, when the cover 10 is positioned over the pool area 16 the inflatable ball 38 remains in a central location of the pool area 16 so that the cover 10 remains centered over the pool area 16 and the pool area 16 remains covered at its perimeter portion 14.

Figure 2:
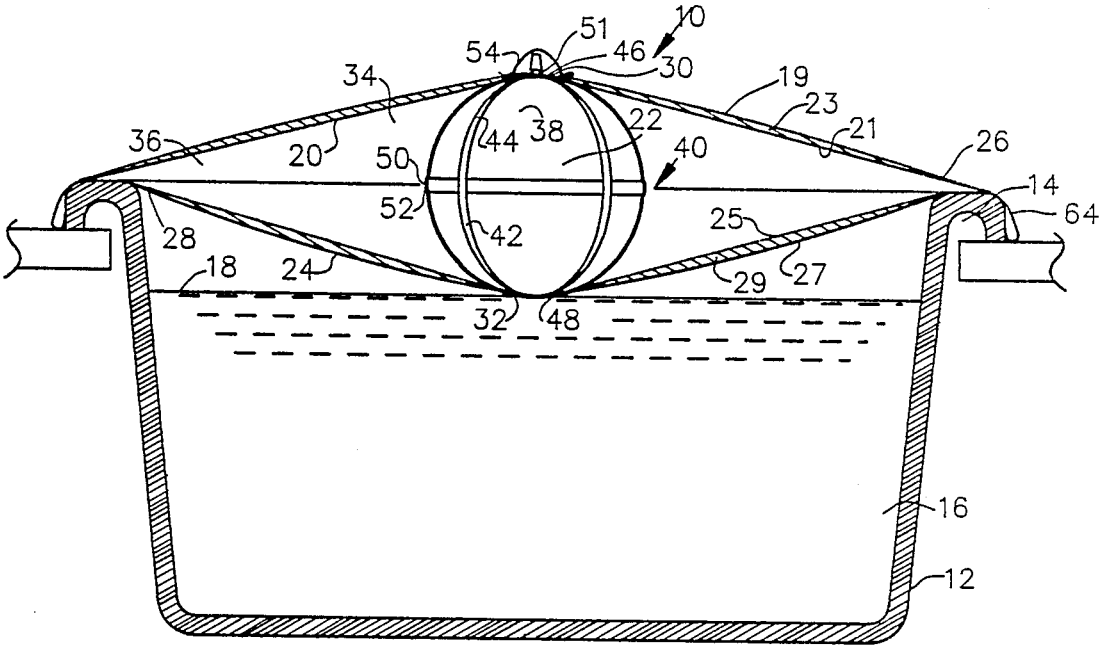
FIG. 2 is a sectional view taken through the vertical center axis of the pool showing the cover in its operating form.

In FIG. 2, there is shown a sectional view taken through the vertical center axis of the pool showing the cover in operation. Before the cover 10 is positioned over the pool area 16 the inflatable ball 38 in a deflated form is inserted through the top central opening 51 and positioned within harness 42, and the inflatable ball 38 is then inflated in the conventional manner by injecting air through tube 54 defining an air passageway 56. After the inflatable ball 38 is inflated the tube 54 is positioned under valve means 58 to insure that the air does not flow back out of the inflatable ball 38 through tube 54. Cover flap 60 then is positioned over valve means 58 and cover flap 60 is secured to the first central portion 30 of the first upper sheet member 20 by fastening means 62 to insure that water or debris does not get into the inside of the cover 10. Fastening means 62 can take any suitable form such as one "Velcro" strip on cover flap 60 which is adapted to engage a complimentary "Velcro" strip on the first central portion 30 of the first upper sheet member 20. The plurality of longitudinal straps 44 and lateral strap 50 hold the inflatable ball 38 securely in position under the first central portion 30 of the first upper flexible sheet 20 such that after the cover 10 is positioned over the pool area 16 the inflatable ball 38 stays in a central portion of the pool area 16 and floats on the upper water surface 18. To summarize some of the main features of the present invention, the first upper flexible sheet member 20 extends radially outwardly from the first central portion 30 to the first perimeter portion 26 at a moderate downward slope so that debris or water that falls on the cover 10 moves outwardly and downwardly from the first center portion 30 of the first upper sheet member 20. The first upper sheet member 20 and the second lower sheet member 24 are attached such that the second perimeter portion 28 of the second lower sheet member 24 is attached to the first perimeter portion 26 of the first upper sheet member 20 substantially entirely around the first perimeter portion 26 of the first upper sheet member 20 and the inflatable ball 38 serves to space the first upper sheet member 20 from the second lower sheet member 24 to define a substantially closed insulating chamber 34 creating an insulating dead air space 36. In the preferred embodiment, the second lower sheet member 24 has two layers 25 and 27 and a layer 29 of microfiber insulation material such as "Thinsulate" positioned between the two layers 25 and 27 such that the layer 29 of insulation material is sealed between the two layers 25 and 27 of the second lower sheet member 24. With the additional layer 29 of insulation material positioned between the two layers 25 and 26 of the second lower sheet member 24 there is created an increased insulation facility in addition to the insulation facility provided by the insulating dead air space 36. The first upper sheet member 20 may also be in the form of two layers 19 and 21 having a layer of microfiber insulation material 23 therebetween which would also provide increased insulation in addition to the insulating dead air space 36 and the insulation created in the second lower sheet member 24. The first upper sheet member 20 and the second lower sheet member 24 as they are attached at first perimeter portion 26 and second perimeter portion 28 are spaced apart by support member 22 to form the cover 10. The cover 10 extends substantially over the entire pool area 16 and over the upper perimeter portion of the pool 14 so that the first perimeter portion 26 of the first upper sheet member 20 and the second perimeter portion 28 of the second lower sheet member 24 extend entirely around the upper perimeter portion of the pool 14 and are secured to the outside of the upper perimeter portion 64 of the pool by attachment means positioned on the deck of the pool 66

Because the first upper sheet member 20 and the lower sheet member 24 are attached outside of the upper perimeter portion of the pool 14 and because the cover 10 of the present invention is in the form of cloth or other flexible material, the cover 10 provides an air tight seal on the edge surface of a wide variety of hot tub or pool shapes. The cover 10 conforms strictly to inherently irregularly shaped upper perimeter portions 64 of the pool or hot tub.

Figure 3:
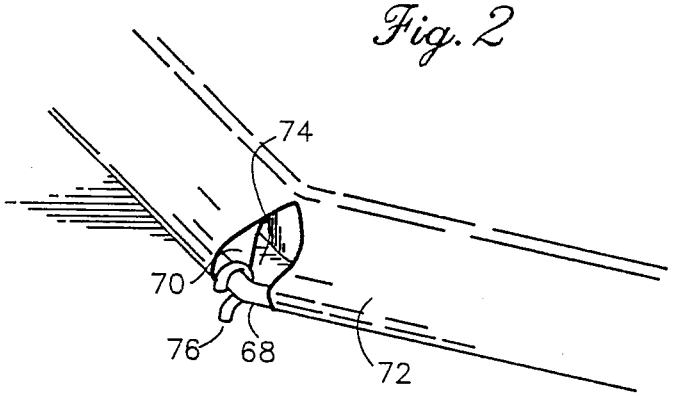
FIG. 3 is side perspective view showing one attachment means used to attach the cover to the outside perimeter of the pool.

In FIG. 3, there is shown one form of attachment means wherein a cord 68 is positioned between the first perimeter portion 26 of the first upper sheet member 20 and the second perimeter portion 28 of the second lower sheet member 24 through channel 70. Cord carrying channel 70 extends entirely around the outer perimeter 72 of the cover. There are a plurality of V-shaped openings 74 positioned around the outer perimeter 72 of the cover so as to expose a portion of cord 68 at periodic intervals. There are a corresponding plurality of hooks 76 attached to the deck of the pool 66 which are adapted to engage the exposed portion of the cord 68 to thereby secure the outer perimeter 72 of the cover over the outside of the upper perimeter portion 64 of the pool.

Figure 4:
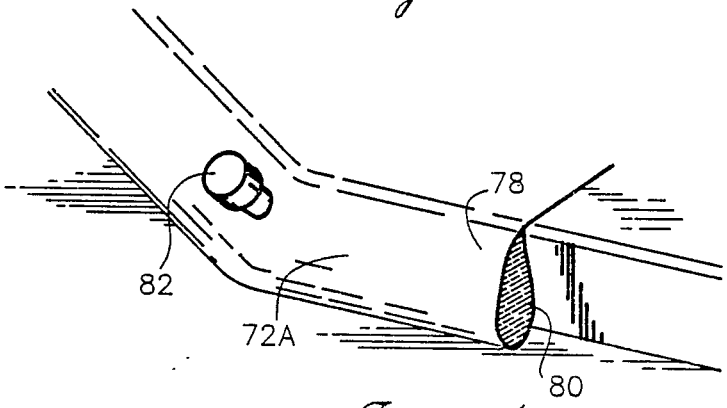
FIG. 4 is a side perspective view showing another attachment means used to attach the cover to the outside perimeter of pool.

Referring now to FIG. 4 of the drawings, there is shown a second embodiment with an alternate configuration for securing the outer perimeter 72 of the cover 10 to the outside of the upper perimeter portion 64 of the pool. FIG. 4 is similar to FIG. 3 and like parts will be numbered with an A suffix. In FIG. 4, it can be seen that the outer perimeter of the cover 72A has a hemmed portion 78 defining a tubular enclosure 80 adapted to receive water or the like such that after the cover 10A is positioned over the pool area 16 the tubular enclosure 80 is filled with water through water valve 82, water valve 82 being adapted to accept or reject water such that after water or the like is injected into the tubular enclosure 80 water valve 82 prevents the water from exiting from the tubular enclosure 80. With water in the tubular enclosure 80, the outer perimeter of the cover 72A rests on the deck surrounding the pool, and the weight of tubular enclosure 80 with the water therein is sufficient to securely hold the cover 10A in place.

A method is also disclosed for covering a pool structure 12 or the like with a cover 10 the pool structure 12 having an upper perimeter portion 14 defining a pool area 16 where water is contained having an upper water surface 18 wherein a first upper flexible sheet member 20 is provided having a first central portion 30 and a first perimeter portion 26 adapted to be positioned around the upper perimeter portion of the pool structure 14 and the first sheet member 20 is arranged to substantially entirely cover the pool area 16. A second lower flexible sheet member 24 is provided having a second central portion 32 and a second perimeter portion 28 and the second perimeter portion 28 of the second sheet member 24 is attached substantially entirely around the first perimeter portion 26 of the first upper sheet member 20. An inflatable support member 22 is first provided in a deflated condition and inserted through the opening 51 into the area defined by the harness 42. The support member 22 is then inflated so that it operatively engages the first central portion 30 of the first sheet member 20 provide vertical support for the first sheet member 20. The support member 22 is adapted to float on the water surface 18 and the support member 22 has a sufficiently large vertical dimension to support the first central portion 30 of the first upper flexible sheet 20 such that the first upper flexible sheet member 20 extends radially outwardly from the first central portion 30 to the first perimeter portion 26 at a moderate downward slope and the second lower flexible sheet member 24 extends radially outwardly from the second central portion 32 to the second perimeter portion 28 at a moderate upward slope. The support member 22 serves to space the first and second sheet members from one another to define a substantially closed insulating chamber 34. The cover 10 is positioned substantially entirely over the pool area 16 and the downward sloping of the first upper sheet member 20 causes debris or water that falls on the cover 10 to move outwardly and downwardly from the first central portion 30 of the first upper sheet member 20. As the first and second sheet members are spaced from one another, an insulating dead air space 36 is created so as to provide heat insulation for water in the pool.

From the foregoing, it can be seen that the applicant's cover for a pool having an upper sheet member and a lower sheet member separated by a support member creates an insulating dead air space which provides efficient heat insulation for water in a pool and as the first upper flexible sheet member extends radially outwardly from the central portion to the perimeter portion at a moderate downward slope, water and debris that fall on the cover move outwardly and downwardly from the central portion of the upper sheet member.

It should be apparent after studying the drawings and reading the description of the preferred embodiment that various changes may be made in the arrangement of the parts and the positioning of the various structures in the assembly. The applicant is not to be limited to the exact embodiment shown which has been given by way of illustration only.

I claim:

1. A cover having a central portion and a perimeter portion adapted to cover a pool structure or the like, the pool structure having an upper perimeter portion defining a pool area where water is contained having an upper water surface, said cover comprising:

(a) a first upper flexible sheet member having a first central portion and a first perimeter portion adapted to be positioned around the perimeter portion of the pool structure, the first sheet member being arranged to substantially entirely cover the pool area;

(b) a second lower flexible sheet member having a second central portion and a second perimeter portion, the second perimeter portion being attached substantially entirely around the first perimeter portion of the first upper sheet member;

(c) a support member having a top and a bottom and being positioned between the upper and lower sheets such that the top of the support member operatively engages the first central portion of the first sheet member and provides vertical support therefor, the support member adapted to float on the water surface, the support member having a sufficiently large vertical dimension to support the central portion of the first upper flexible sheet member such that the first upper flexible sheet member extends radially outwardly from the first centeral portion to the first perimeter portion at a moderate downward slope and the second lower flexible sheet member extends radially outwardly from the second central portion to the second perimeter portion;

(d) the cover being characterized in that in a deployed position covering the pool area, the first and second sheet members are spaced from one another to define a substantially closed insulating chamber;

(e) the support member being inflatable and being provided with a valve means whereby the inflatable support member may be deflated;

(f) said cover further comprising:

i. an opening positioned in the central portion of one of the first and second sheet members to receive the inflatable support member; and ii. harness locating means attached to the central portion of the cover and defining a receiving area for the inflatable support member so that the harness locating means serves to hold the inflatable support member in the central portion of the cover so that the inflatable support member remains in a central location of the pool area and the pool area remains covered at its perimeter portion;

whereby in the deployed position the downward sloping of the first upper sheet member causes debris or water that falls on the cover to move outwardly and downwardly from the first central portion of the first upper sheet member and as the first and second sheet members are spaced from one another creating an insulating dead air space so as to provide heat insulation for water in the pool.

2. The cover as defined in claim 1 wherein the opening has a sufficiently large horizontal dimension to receive the inflatable support member in a deflated form, with the horizontal dimension being sufficiently small to retain the support member in its inflated condition.

* * * * *